US006459344B1

(12) United States Patent
Pavio et al.

(10) Patent No.: US 6,459,344 B1
(45) Date of Patent: Oct. 1, 2002

(54) SWITCH ASSEMBLY AND METHOD OF FORMING THE SAME

(75) Inventors: Anthony M. Pavio, Paradise Valley, AZ (US); Jenn-Hwa Huang, Gilbert, AZ (US); Wang-Chang Gu, Scottsdale, AZ (US)

(73) Assignee: Motorola, Inc., Schaumburg, IL (US)

( * ) Notice: Subject to any disclaimer, the term of this patent is extended or adjusted under 35 U.S.C. 154(b) by 72 days.

(21) Appl. No.: 09/810,681

(22) Filed: Mar. 19, 2001

(51) Int. Cl.[7] ..... H01P 1/10
(52) U.S. Cl. ..... 333/101; 333/105; 333/262
(58) Field of Search ..... 333/101, 105, 333/262

(56) References Cited

U.S. PATENT DOCUMENTS 5,121,089 A 6/1992 Larson
6,072,686 A 6/2000 Yarbrough
6,091,037 A 7/2000 Bachschmid
6,133,807 A 10/2000 Akiyama et al.

*Primary Examiner*—Don Phu Lee
(74) *Attorney, Agent, or Firm*—Douglas W. Gilmore; William E. Koch

(57) ABSTRACT

A microelectromechanical system (MEMS) switch assembly (10) and a method of forming the MEMBS switch assembly (10) is provided that includes a switching member (12) having a first portion (34) that is at least partially formed with a first material having a first dielectric constant and a second portion (36) that is at least partially formed with a second material having a second dielectric constant. Furthermore, the switching member (12) further includes a first lead (14) spaced apart from a second lead (16) for contacting the switching member (12). In operation, the switching member (12) is configured for movement such that the first portion (34) and second portion (36) of the switching member (12) can provide variable electrical connections between the first lead (14) and second lead (16).

18 Claims, 1 Drawing Sheet

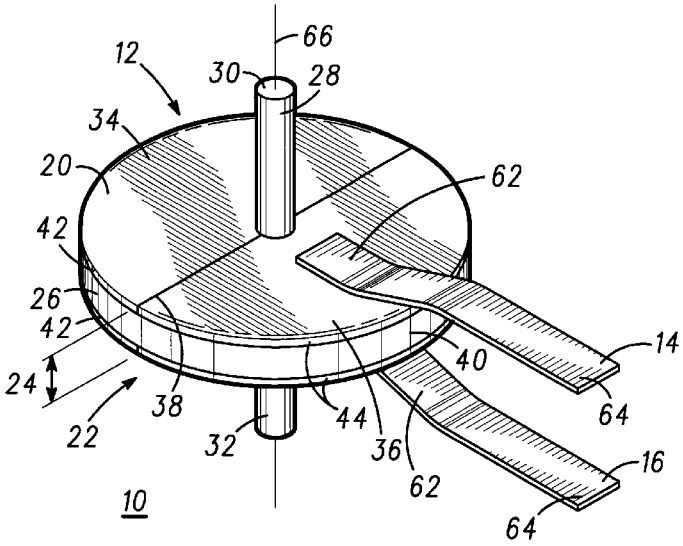
FIG. 1
FIG. 2
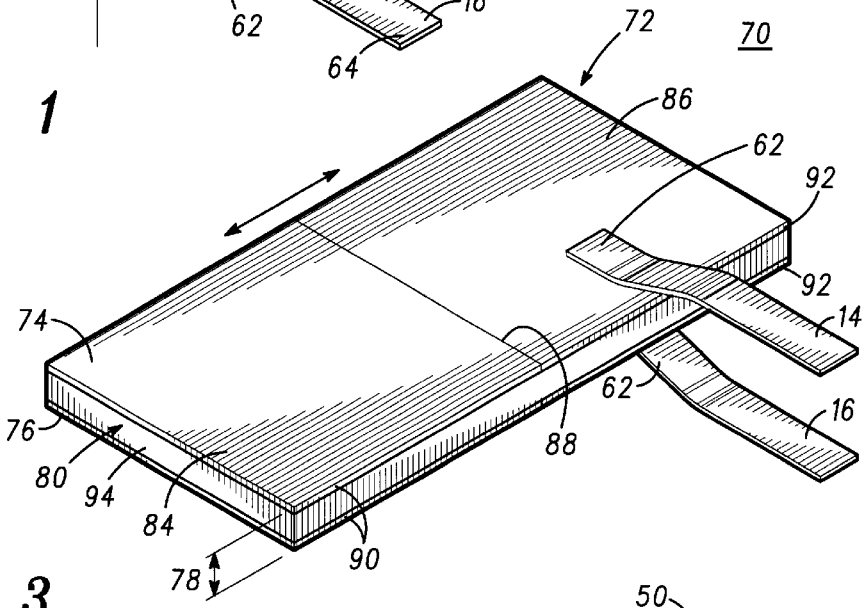
FIG. 3
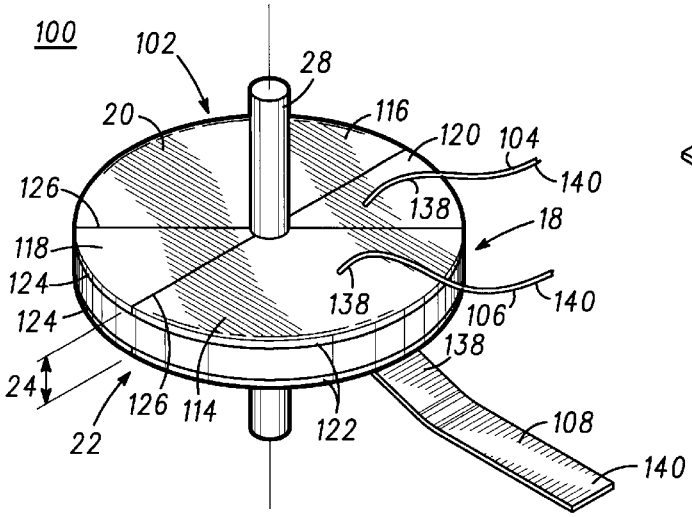
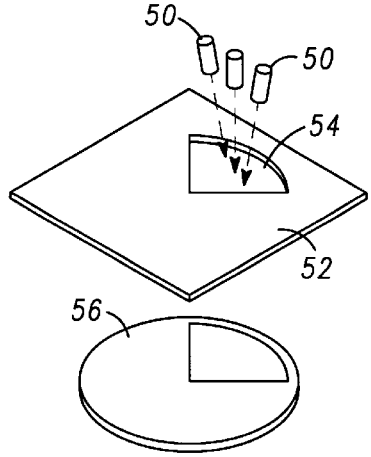
FIG. 4

SWITCH ASSEMBLY AND METHOD OF FORMING THE SAME

FIELD OF THE INVENTION

The present invention generally relates to a microelectromechanical system (MEMS), and more particularly to a MEMS switch assembly and a method of forming the MEMS switch assembly.

BACKGROUND OF THE INVENTION

Communications systems such as wireless handsets and other electrical and/or mechanical systems often require high performance switch assemblies that exhibit one or more of the following characteristics: small size, low power consumption in the on-state, high isolation in the off-state, low signal distortion or low activation voltage. Accordingly, it is desirable to provide a MEMS switch assembly that can offer one or more of these characteristics in a variety of applications such as radio frequency (RF) and microwave applications and a method for forming the MEMS switch assembly. Furthermore, other desirable features and characteristics of the present invention will become apparent from the subsequent detailed description of the drawings and the appended claims, taken in conjunction with the accompanying drawings.

BRIEF DESCRIPTION OF THE DRAWINGS

The present invention will hereinafter be described in conjunction with the appended drawing figures, wherein like numerals denote like elements, and:

FIG. 1 illustrates a perspective view of a microelectromechanical system (MEMS) switch assembly according to a non-limiting aspect of the present invention;

FIG. 2 illustrates a perspective view of another switch assembly formed according to a non-limiting aspect of the present invention;

FIG. 3 illustrates a perspective view of still another switch assembly formed according to a non-limiting aspect of the present invention; and FIG. 4 illustrates a perspective view of a portion of a switch assembly being formed according to a non-limiting aspect of the present invention.

DETAILED DESCRIPTION OF THE DRAWINGS

The following detailed description of a preferred embodiment is merely exemplary in nature and is not intended to limit the invention or the application and uses of the invention.

The present invention provides a microelectromechanical system (MEMS) switch assembly for radio frequency (RF), Microwave or other applications. Generally, the switch assembly includes a switching member and a first lead that is spaced apart from a second lead. The switching member includes a first portion having an insulating material with a first dielectric constant and a second portion having a conductive material with a second dielectric constant. The switching member is selectively moveable (e.g., translatable, rotatable or otherwise mobile) to allow the second portion of the switching member to provide a robust electrical connection between the first and second leads when such a robust connection is desired and to allow the first portion to provide a less robust electrical connection between the first lead and the second lead when a less robust connection is desired. As defined herein, the term "robust electrical connection" should be construed to include any connection capable of carrying enough current or having a low enough capacitance for its intended application. Also, as defined herein, the term "less robust electrical connection" should be construed to include any connection less robust than the connection allowed by the first portion of the switching member, including a substantially non-existent electrical connection or short. Preferably, the first lead and second lead are configured for substantially continuous contact with one or more surfaces of the switching member as the switching member is moved to selectively provide more and less robust connections between the leads.

Referring to FIG. 1, there is illustrated a MEMS switch assembly 10 according to one preferred exemplary embodiment of the present invention. The MEMS switch assembly 10 comprises a switching member 12, a first lead 14 and a second lead 16. The switching member 12 includes a cylindrical or "disk-shaped" portion 18 having a first generally circular surface 20 generally opposing a second generally circular surface 22. The first surface 20 and second surfaces 22 are separated by a thickness 24. Furthermore, the switching member 12 includes an annular outer periphery 40 that extends along the thickness 24 of the switching member 12. A cylindrical rod 28 that can be attached to or integral with the disk portion 18 supports the disk portion 18. The cylindrical rod 28 extends generally centrally through the disk portion 18 and through the first surface 20 and second surface 22 of the disk portion 18 and includes a first end 30 and a second end 32.

In the embodiment illustrated in FIG. 1, the disk portion 18 of the switching member 12 is divided into a first portion 34 and a second portion 36 by an interface 38. The first portion 34 is at least partially formed of one or more insulating materials. Without intending to be limited thereby, insulating materials for the first portion 34 may include ceramics or other materials having relatively high dielectric constants. Examples of insulating materials may include titanates or zirconates such as lead zirconate ($PbZrO_3$) to strontium titanate ($SrTiO_3$). Appropriate values for the first dielectric constant ($K_1$) of the insulating materials range from about 100 to about 500, and preferably are within the range of about 150 to about 200, and more preferably are about 170 or less than about 170. The second portion 36 is at least partially formed of a relatively conductive material such as borosilicate glass or any other suitable material having a second relatively low dielectric constant ($K_2$). Appropriate values for the second dielectric ($K_2$) of the relatively conductive material of the second portion 36 range from about 2 to 10 and preferably are within the range 3 to 6 and more preferably are about 3.9 or less than about 3.9.

The first portion 34 may be attached to the second portion 36 in a variety of manners to form the switching member 12. The first portion 34 may be adhesively or otherwise secured to the second portion 36. Furthermore, the rod 28 may be secured to the first portion 34 and second portion 36 using any number of techniques such as adhesive attachment or otherwise.

In a preferred embodiment, the cylindrical rod 28 is integrally formed as a single component with a generally annular portion 40 and the cylindrical rod 28 and the annular portion 40 are formed of a metal such as gold, aluminum or the like. The annular portion 40 and the rod 28 can also be formed of silicon or other suitable materials. Also preferable, the insulating and conductive materials of the first portion 34 and second portions 36 are deposited or otherwise attached to the annular portion 40 to respectively form layers (42,44) of such materials. Deposition of the materials can be accomplished by physical vapor deposition methods such as sputtering with a solid cathode or by other suitable deposition methods. Momentarily referring to FIG. 4, cathodes 50 can be used to sputter materials through a shadow mask 52 having a pattern 54 such that the materials are deposited according to the pattern 54 upon a substrate 56 such as that shown in FIG. 4 or upon the annular portion 40 of the assembly 10 of FIG. 1.

Referring to FIG. 1, the first lead 14 and second lead 16 are elongated metal strips that are generally "S-shaped" and extend between a first end 62 and a second end 64. However, any number of shapes and configurations can be utilized for the leads in accordance with the present invention. Furthermore, the first lead 14 and second lead 16 are in contact with one of the first surface 20 or second surface 22 of the switching member 12. The first lead 14 and second lead 16 can be arranged such that the first end 62 of the first lead 14 is in contact with the first surface 20 of the switching member 12 and the first end 62 of the second lead 16 is in contact with the second surface 22 of the switching member 12. The skilled artisan will recognize that a variety of leads are known and can be used in accordance with the present invention. Optionally, the first surface 20 and the second surface 22 of the switching member 12 can be metallized to assist in contacting the first lead 14 and the second lead 16, and a gap is preferably provided between the metallized surfaces of the first portion 34 and second portion 36 to insure substantial electrical (e.g., DC, AC and RF) isolation of the first portion 34 from the second portion 36. The second end 64 of the first lead 14 and second lead 16 are electrically connected to components (e.g., circuits, antennas, filters or the like) within an electrical device).

To install the MEMS switch assembly 10 into an electrical device such as a portable telephone, cellular telephone or any other number of mechanical and/or electrical devices, the first end 30 and second end 32 of the support member or cylindrical rod 28 can be inserted into cavities (not shown) formed within the device such that the switching member 12 is rotatable about a central axis 66 that extends through about the center of the switching member 12. In operation, the switching member 12 may be selectively rotated such that the second portion 36 provides a robust electrical connection between the first lead 14 and second lead 16 and the switching member 12 can be selectively configured with a rotation such that the first portion 36 provides a less robust electrical connection between the first lead 14 and the second lead 16. The skilled artisan will recognize that the MEMS switch assembly 10 can be used to open and close a variety of electrical connections and/or provide varying impedances and that the first end 62 and second end 64 of the first lead 14 and second lead 16 can be connected to portions of a variety of circuits for switching a component in or out of the circuit.

In one exemplary embodiment, the switching member 12 can be used as an on/off switch for microwave or RF applications. In such an embodiment, the switching member 12 can be selectively rotated about the central axis 66. During rotation, the first end 62 of the first lead 14 and second lead 16 can maintain a substantially continuous contact with the first surface 20 and second surface 22 of the switching member 12. The switching member 12 can be rotated to at least two positions (i.e., an ON position and an OFF position). At a first position, the second portion 36 of the switching member 12 is physically located between the first lead 14 and the second lead 16, thereby providing a robust electrical connection between the first lead 14 and the second lead 16. This robust connection is provided with the low dielectric constant materials of the second portion 36. At the first position, the MEMS switch assembly 10 can be configured in the ON position. At a second position, which can be achieved by rotating the switching member 12 approximately one hundred eighty degrees about the axis 66, the first portion 34 of the switching member 12 is physically located between the first lead 14 and the second lead 16, thereby providing a less robust electrical connection (e.g., a substantially non-existent electrical connection) between the first lead 14 and the second lead 16 because of the higher dielectric constant of the materials of the first portion 34. At the second position, the switch assembly 10 can be configured in the OFF position.

In another preferred exemplary embodiment of the present invention, the switching member 12 can be used for configuring an antenna in a portable telephone, cellular telephone or any other electrical device utilizing an antenna. When used for configuring an antenna, a second set of leads (not shown) may be contacted with the first surface 20 and the second surface 22 of the switching member 12 in addition to the first lead 14 and the second lead 16. One of the first set or second set of leads is connected to a transmitter (not shown) while the other set of leads is connected to a receiver (not shown) The leads are configured for contact with the first surface 20 and second surface 22, and the switching member 12 is rotatable between at least two positions. When the phone is receiving transmissions, the member 12 is in a first position wherein the first high dielectric portion 34 is between the leads connected to the transmitter and the second low dielectric portion 36 is between the leads connected to the receiver. When the phone is transmitting, the member 12 is in a second position wherein the second low dielectric portion 36 is between the leads connected to the transmitter and the first high dielectric portion 34 is between the leads connected to the receiver.

Rotation of the switching member 12 can be accomplished with a variety of mechanisms and with a variety of methods and techniques. For example, the switching member 12 may be mechanically rotated with gears or the like. The switching member 12 can be rotated magnetically or electrostatically. The person of skill in the art will recognize that a variety of methods and/or apparatus are available for rotating the switching member 12 that are within the scope of the present invention.

Referring to FIG. 2, there is illustrated an alternate embodiment of a MEMS switch assembly 70 according to a preferred exemplary embodiment of the present invention. The MEMS switch assembly 70 comprises an alternative switching member 72 for use with the first lead 14 and the second lead 16 discussed with reference to FIG. 1. In the alternate embodiment of FIG. 2, the switching member 72 is generally rectangular and has a first rectangular surface 74 generally opposing a second rectangular surface 76. The first surface 74 and second surface 76 are separated by a thickness 78. Furthermore, the switching member 72 includes a generally rectangular outer periphery 80 that extends along the thickness 78 of the switching member 72.

In the alternate embodiment of the MEMS switch assembly 70 according to a preferred exemplary embodiment of the present invention, the switching member 72 is divided into a first portion 84 and a second portion 86 by an interface 88. In a non-limiting embodiment, the first portion 84 is at least partially formed of an insulating material such as those described for the first portion 34 of the switching member 12 of FIG. 1, and the second portion 86 is at least partially formed of a conductive material such as those described for the second portion 36 of the switching member 12 of FIG.

1. The insulating and conductive materials can be applied in a first layer 90 and second layer 92, respectively, to a rectangular metal substrate 94 by deposition techniques such as those previously described in this detailed description of the drawings. The first lead 14 and second lead 16 can be arranged such that the first end 62 of the first lead 14 is in contact with the first surface 74 of the switching member 72 and the first end 62 of the second lead 16 is in contact with the second surface 76 of the switching member 72.

The switching member 72 can be supported by the first lead 14 and second lead 16 and/or can be supported by a surface (not shown) of an electrical device along which the switching member 72 can be configured to slide and/or translate. Other suitable supports may also be used to support the switching member 72 while still allowing the switching member 72 to translate. In operation, the switching member 72 can be selectively translated such that the second portion 86 provides a robust electrical connection between the first lead 14 and second lead 16 and the switch member 72 can be selectively translated such that the first portion 84 provides a less robust electrical connection between the first lead 14 and second lead 16. During such translation, the end 62 of the first lead 14 and second lead 16 can be configured to maintain substantially continuous contact with the first surface 74 and second surface 76 of the switching member 72.

Translation of the switching member 12 can be accomplished with a variety of apparatus and/or methods. For example, the switching member 12 can be mechanically, electrostatically, magnetically actuated or actuated by any number of suitable means, for example. The skilled artisan will recognize that a variety of apparatus and/or methods of translating the switching member 72 can be employed within the scope of the present invention.

Referring to FIG. 3, there is illustrated still another alternate of a MEMS switch assembly 100 formed according to a preferred exemplary embodiment of the present invention, which is particularly suited for high-speed operations (e.g., as an antenna switch for time division multiple access (TDMA) radio applications). The MEMS switch assembly 100 comprises a switching member 102 similar in geometric configuration to the switching member 12 of FIG. 1. The MEMS switch assembly 100 further comprises a first lead 104, a second lead 106 and a third lead 108. The switching member 102 of FIG. 3 further comprises the rod 28 and the cylindrical or "disk shaped" portion 18 that has the first circular surface 20 generally opposing the second circular surface 22, wherein the first surface 20 and second surface 22 are separated by a thickness 24 as discussed with reference to FIG. 1.

In the alternate embodiment shown in FIG. 3, the cylindrical switching member 102 is divided into a first portion 114, a second portion 116, a third portion 118 and a fourth portion 120 by a pair of interfaces 126. In a non-limiting embodiment, the first portion 114 and second portion 116 are at least partially formed of an insulating material such as those materials having a first higher dielectric constant ($K_1$) previously discussed for the switch assembly 10 of FIG. 1. The third portion 118 and the fourth portion 120 are at least partially formed of a conductive material such as those materials having a second lower dielectric constant ($K_2$) previously discussed for the switch assembly 10 of FIG. 1. The first portion 114 and second portion 116 can be attached to the third portion 118 and fourth portion 120 in a variety of configurations to form the switching member 102. Preferably, the insulating and conductive materials are respectively deposited in layers (122,124) on the annular portion 40 of the switching member 102 in a manner similar to that previously described for the switching member 12 of FIG. 1. Each of the first lead 104, second lead 106 and third lead 108 are elongated metal strips that are generally "S-shaped" and extend between a first end 138 and a second end 140. However, any number of shapes and configurations can be utilized for the leads in accordance with the present invention.

Furthermore, each of the leads (104,106,108) is placed into contact with the surfaces (20,22) of the switching member 102. The leads (104,106,108) can be arranged such that the first end 138 of the first lead 104 and the second lead 106 are in contact with the first surface 20 of the switching member 102 and the first end 138 of the third lead 108 is in contact with the second surface 22 of the switching member 102.

The MEMS switch assembly 100 can be mounted or installed within an electrical device in a manner substantially similar or identical to the installation of the assembly 10 of FIG. 1 or by other suitable installation techniques. In operation, the switching member 102 may be selectively rotated such that the third portion 118 and fourth portion 120 can provide a robust electrical connection between the first lead 104 and third lead 108 or between the second lead 106 and third lead 108 such that the first portion 114 and second portion 116 provide a less robust electrical connection between the first lead 104 and third lead 108 and between the second lead 106 and third lead 108. Rotation of the switching member 102 can be provided by methods and/or apparatus similar to that of the switching member 12 previously described with reference to FIG. 1 or by other appropriate methods and/or apparatus. The skilled artisan will recognize that by appropriately timing the rotation of the switching member 102 to selectively provide robust electrical connections between the leads (104,106,108), the MEMS switch assembly 100 can provide appropriate switch for TDMA applications, and any other existing or future cellular communication protocol, and future generations thereof. The skilled artisan will further recognize that such timing will depend upon the particular TDMA application.

Although various embodiments of this invention have been shown and described, it shall be understood that variations, modifications and substitutions, as well as rearrangements and combinations of the preceding embodiments can be made by those skilled in the art without departing form the novel spirit and scope of this invention.

What is claimed is:

1. A microelectromechanical system (MEMS) switch assembly, comprising:

a switching member having a first portion that is at least partially formed of an insulating material with a first dielectric constant and a second portion that is at least partially formed of a conductive material with a second dielectric constant substantially lower than said first dielectric constant, said switching member configured for movement between at least a first position and a second position;

a first lead configured for substantially continuous contact with a first surface of said switching member; and a second lead spaced apart from said first lead and configured for substantially continuous contact with a second surface of said switching member, said conductive material of said switching member configured to provide a robust electrical connection between said first lead and said second lead when said switching member is in said first position and said insulating material is configured to provide a substantially less robust connection between said first lead and said second lead when said switching member is in said second position.

2. The MEMS switch assembly of claim 1, wherein said switching member comprises a disk portion having said first surface generally opposing said second surface, said disk portion configured for rotation between said first position and said second position.

3. The MEMS switch assembly of claim 2, wherein said insulating material and said conductive material are deposited upon an annular substrate to form said disk portion.

4. The MEMS switch assembly of claim 3, wherein said disk portion is supported by a rod, said disk portion and said rod are configured for rotation.

5. The MEMS switch assembly of claim 1, further comprising:

a third lead configured for substantially continuous contact with said first surface of said switching member; and a fourth lead spaced apart from said third lead and configured for substantially continuous contact with said second surface of said switching member, wherein said first lead and said second lead are electrically connected to a receiver and said third lead and said fourth lead are connected to a transmitter such that said MEMS switch assembly can operate to switch connections between said transmitter and said receiver.

6. The MEMS switch assembly of claim 1, wherein said switching member comprises a third portion that is at least partially formed of an insulating material and a fourth portion that is at least partially formed of a conductive material, said switching member is configured for continuous rotation through said first and second positions to provide an antenna switch for time division multiple access (TDMA) applications.

7. The MEMS switch assembly of claim 1, wherein said first dielectric constant is within the range of about 150 to about 200.

8. The MEMS switch assembly of claim 1, wherein said second dielectric constant is within the range of about 3 to about 6.

9. The MEMS switch assembly of claim 1, wherein said insulating material is selected from the group consisting of titanates and zirconates.

10. A microelectromechanical system (MEMS) switch assembly, comprising:

a switching member having a rod integrally formed with an annular portion, said annular portion having a first portion with an insulating material deposited thereon and a second portion with a conductive material deposited thereon for forming a disk portion, said insulating material having a first dielectric constant substantially higher than a second dielectric constant of said conductive material, said switching member rotatable about an axis and rotatable between at least a first position and a second position;

a first lead configured for substantially continuous contact with a first surface of said switching member;

a second lead spaced apart from said first lead and configured for substantially continuous contact with a second surface of said switching member, said conductive material of said switching member configured to provide a robust electrical connection between said first lead and said second lead when said switching member is in said first position, said insulating material configured to provide a substantially less robust connection between said first lead and said second lead when said switching member is in said second position.

11. The microelectromechanical system (MEMS) switch assembly of claim 10, wherein said insulating material is selected from the group consisting of titanates and zirconates.

12. The microelectromechanical system (MEMS) switch assembly of claim 10, further comprising:

a third lead configured for substantially continuous contact with said first surface of said switching member; and a fourth lead spaced apart from said first lead and configured for substantially continuous contact with said second surface of said switching member, wherein said first lead and said second lead are configured for a first electrical connection to a receiver and said third lead and said fourth lead are configured for a second electrical connection to a transmitter such that the MEMS switch assembly can operate to switch connections between said transmitter and said receiver.

13. The microelectromechanical system (MEMS) switch assembly of claim 10, wherein said first dielectric constant is within the range of about 150 to about 200.

14. The microelectromechanical system (MEMS) switch assembly of claim 10, wherein said second dielectric constant is within the range of about 3 to about 6.

15. A method for forming a MEMS switch assembly, said method comprising:

providing a substrate;

depositing an insulating material and a conductive material upon said substrate to form a switching member;

placing a first lead and a second lead in substantially continuous contact with said switching member;

configuring said switching member such that said conductive material is disposed between said first lead and said second lead when a robust electrical connection is desired and such that said insulating material is disposed between said first lead and said second lead when a less robust electrical connection is desired.

16. The method for forming the MEMS switch assembly of claim 15, wherein said first dielectric constant is within the range of about 150 to about 200.

17. The method for forming the MEMS switch assembly of claim 15, wherein said second dielectric constant is within the range of about 3 to about 6.

18. The method for forming the MEMS switch assembly of claim 15, wherein said insulating material is selected from the group consisting of titanates and zirconates.

* * * * *